US005550887A

United States Patent [19]

Schmal et al.

[11] Patent Number: 5,550,887

[45] Date of Patent: Aug. 27, 1996

[54] PHASE CONTRAST X-RAY MICROSCOPE

[75] Inventors: Günter Schmal, Göttingen; Dietbert Rudolph, Einbeck-Wenzen, both of Germany

[73] Assignee: Carl-Zeiss-Stiftung, Heidenheim (Brenz), Germany

[21] Appl. No.: 436,284

[22] Filed: May 16, 1995

[30] Foreign Application Priority Data

Sep. 15, 1993 [DE] Germany ..... 43 31 251.9

[51] Int. Cl.[6] ..... G21K 7/00

[52] U.S. Cl. ..... 378/43; 378/145

[58] Field of Search ..... 378/43, 84, 85, 378/145

[56] References Cited

U.S. PATENT DOCUMENTS 4,953,188 8/1990 Siegel et al. ..... 378/43
5,119,411 6/1992 Nakamura ..... 378/206
5,204,887 4/1993 Hayashida et al. ..... 378/43
5,434,901 7/1995 Nagai et al. ..... 378/43

FOREIGN PATENT DOCUMENTS 0270968 6/1988 European Pat. Off. .
0475093 3/1992 European Pat. Off. .

*Primary Examiner*—David P. Porta

[57] ABSTRACT

An X-ray microscope has the following features: a pulsed x-ray source that delivers an intense line radiation, an annular condenser that focuses the radiation of the X-ray source on the object to be investigated, an X-ray optics constructed as a micro zone plate that images the object with high resolution on an X-ray detector, and a phase ring positioned in the rear focal plane of the micro zone plate and applies to the zero order X-ray radiation coming from the object a phase shift, with respect to the higher order radiation deflected by the object structures, which is determined by the thickness and material of the phase ring. The phase shift amounts, for example, to 90° or 270°.

13 Claims, 1 Drawing Sheet

PHASE CONTRAST X-RAY MICROSCOPE

BACKGROUND OF THE INVENTION

This invention relates to a phase contrast X-ray microscope.

RELEVANT PRIOR ART

Various X-ray microscopes are known, which differ more or less in their optical construction as regards the X-ray source used, the condenser optics for focusing the X-ray radiation on the object to be investigated, and the X-ray objective for imaging the object on the imaging X-ray detector that is used.

An X-ray microscope that has the following construction is described in U.S. Pat. No. 5,222,113, which issued Jun. 22, 1993.

- a pulsed X-ray source, which delivers an intense line radiation,
- a mirror condenser, which focuses the radiation of the X-ray source on the object to be investigated, and
- an X-ray objective constructed as a micro zone plate, which images the object with a high resolution onto the X-ray detector.

This microscope makes possible X-ray imaging in amplitude contrast with a resolution that is ten times better than that which can be achieved with light microscopes.

It is stated in U.S. Pat. No. 4,870,674, which issued Sep. 26, 1989, that X-ray microscopy can also be advantageously carried out in phase contrast. The special advantage consists in that because of the high contrast, objects can be investigated with a smaller exposure to radiation. There is described in U.S. Pat. No. 4,870,674 an arrangement in which there is fitted to the X-ray objective, which is constructed as a zone plate, a central circular disk that shifts the phase of the zero order of the object radiation in a suitable manner. This arrangement has the following disadvantages in practice: The phase plate must be small enough to affect only the zero order of the object radiation, and not also higher orders of low spatial frequency of the object structure. However, this requires a spatially coherent, i.e., practically point-like, X-ray source. X-ray sources that are available in practice have a relatively large spatial extension and thus do not fulfill these requirements. When such sources are used, the circular phase plate in the Fourier plane of the objective has to be so large that a portion of the higher orders of the object radiation is also affected by the phase plate. A further disadvantage, which is very important in practice, is that radiation of the zero order of the zone plate objective adds to the image at the site of the detector, and hence gives rise to considerable interference.

An independent phase contrast X-ray microscope that was at the same time of high resolution and of high brightness did not exist until now. Such a system is however required for the investigation of structures in aqueous surroundings. Fields of application are, for example, biology, medicine, pharmacology, colloid chemistry, and earth sciences.

SUMMARY OF THE INVENTION

The object of the present invention is to avoid abovementioned disadvantages.

According to the invention, this object is achieved by an X-ray microscope with the following features:

- a pulsed x-ray source that delivers an intense line radiation,

- an annular condenser that focuses the radiation of the X-ray source on the object to be investigated,
- an X-ray optics constructed as a micro zone plate that images the object with high resolution on an X-ray detector, and
- a phase ring that is in the rear focal plane of the micro zone plate and applies to the zero order X-ray radiation coming from the object a phase shift, with respect to the higher order radiation deflected by the object structures, which phase shift is determined by the thickness and material of the phase ring. The phase shift amounts, for example, to 90° or 270°.

The X-ray condenser of high aperture is constructed as an annular condenser. An annular phase plate is inserted into the Fourier plane of the X-ray objective. Since the condenser in the X-ray microscope is at a large distance, in comparison with the focal length of the X-ray objective, it is imaged by the X-ray objective practically in the Fourier plane of the latter. An annular condenser is thus imaged into an annular region which corresponds to the size of the phase plate. Even an X-ray source of relatively large spatial extension can be used with such an arrangement. X-ray radiation from a substantially larger aperture cone is thus used by the condenser than in the known arrangement with a centrally arranged circular phase plate. The second disadvantage of the centrally arranged circular phase plate, namely, the interfering radiation of the zero order of the zone plate objective, is also avoided with this arrangement. A large image field that is free from this radiation is obtained with this arrangement.

DESCRIPTION OF THE DRAWING

The phase contrast X-ray microscope according to the invention is shown schematically in FIG. 1.

DETAILED DESCRIPTION OF PREFERRED EMBODIMENTS

Figure 1:
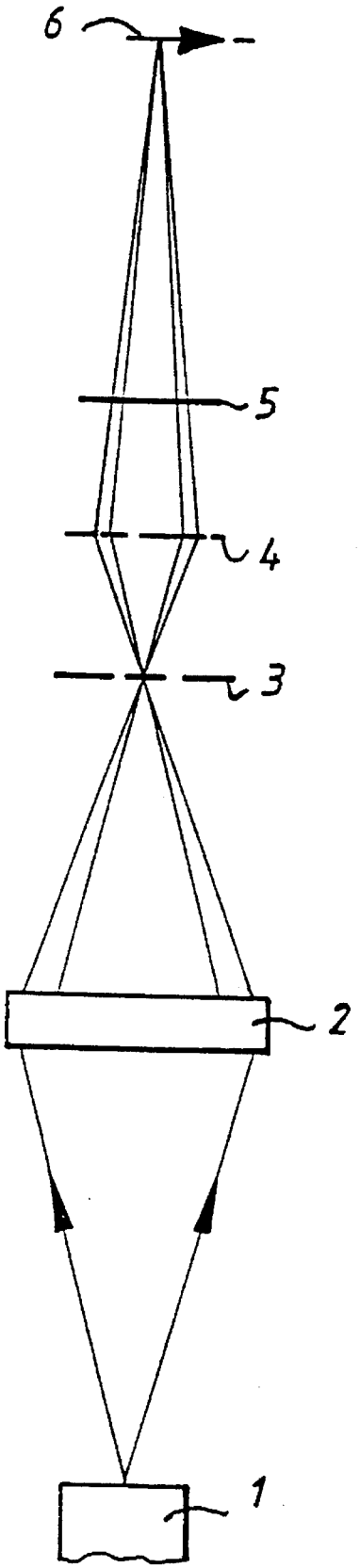

The X-ray source is denoted by (1). A pulsed plasma source is concerned here, for example, a plasma focus or a laser plasma source. Such a plasma source generates X-ray pulses of short temporal duration, preferably comprising line radiation. The X-ray radiation emitted by the plasma source is focused by means of an annular condenser (2) on the sample (3) to be investigated. The condenser can be, for example, an annular section from an ellipsoid of rotation as a mirror condenser for grazing incidence, or an annular zone plate as a zone plate condenser. A combination of the two is also possible. A mirror condenser can also be coated with a multiple layer to increase the reflectivity and also to enlarge the usable angle of incidence. A so-called micro zone plate (4) is arranged over the object plane as the X-ray objective. This micro zone plate represents the actual imaging optics of the X-ray microscope. Its distance from the object plane is greatly exaggerated in the FIGURE. In actuality, the micro zone plate has a diameter of about 20–50 μm and is located at about 0.5–1 mm above the object to be investigated. A phase ring (5), on a foil that is sufficiently transparent for the X-ray radiation used, is located in the rear focal plane of the micro zone plate (4). The phase ring applies to the zero order radiation of the object structures a phase shift, which can for example amount to 90° or 270° C., with respect to the radiation deflected by the object structures. At the same time, the phase ring can attenuate the zero order X-ray radiation of the object structures and thus further increase the image contrast. To achieve this, it can be advantageous to construct the phase ring as a combination of two or more materials in order to choose the phase shift and the absorption in a suitable manner for the desired contrast. The phase ring can also be constructed such that only an attenuation, combined with a phase shift of 180°, is achieved. The phase shifting properties of the object structures are used by means of the phase shift of, for example, 90° or 270° to increase the image contrast. The phase shifted and attenuated zero order radiation components of the radiation coming from the object interfere in the image plane with the higher order radiation components which are not affected by the phase ring, and thus produce a high contrast, enlarged image of the object. This image of the object can, for example, be detected with a CCD detector in the image plane (6) and displayed on a monitor. In addition, the image can be further processed by known methods of image processing.

We claim:

1. Phase contrast X-ray microscope comprising:

a pulsed X-ray source for generating an intense line radiation, an annular condenser for focusing radiation from said X-ray source on an object to be investigated, an X-ray detector X-ray optics constructed as a micro zone plate with a rear focal plane, for imaging said object at high resolution on said X-ray detector, and a phase ring in said rear focal plane of said micro zone plate, for applying to zero order X-ray radiation coming from said object a phase shift with respect to higher order radiation deflected by said object, which phase shift is determined by thickness and material of said phase ring.

2. Phase contrast X-ray microscope according to claim 1, wherein said condenser comprises an annular mirror for grazing incidence.

3. Phase contrast X-ray microscope according to claim 1, wherein said condenser comprises an annular zone plate.

4. Phase contrast X-ray microscope according to claim 1, wherein said condenser comprises a combination of an annular mirror for grazing incidence with an annular zone plate.

5. Phase contrast X-ray microscope according to claim 1, wherein said condenser comprises an annular mirror coated with a multiple layer.

6. Phase contrast X-ray microscope according to claim 1, wherein said condenser comprises a combination of a mirror coated with a multiple layer and an annular zone plate.

7. Phase contrast X-ray microscope according to claim 1, wherein said phase ring is located on a carrier foil that is sufficiently transparent to X-ray radiation used.

8. Phase contrast X-ray microscope according to claim 7, wherein said carrier foil comprises a silicon foil.

9. Phase contrast x-ray microscope according to claim 1, wherein said phase ring comprises a copper ring, 0.46 μm in thickness, located on a silicon foil about 0.1–0.3 μm in thickness.

10. Phase contrast X-ray microscope according to claim 1, wherein said phase ring comprises a combination of at least two different materials.

11. Phase contrast X-ray microscope according to claim 1, wherein said phase ring is arranged to phase shift said zero order X-ray radiation by 90°.

12. Phase contrast X-ray microscope according to claim 1, wherein said phase ring is arranged to phase shift said zero order X-ray radiation by 270°.

13. Phase contrast X-ray microscope according to claim 1, wherein said phase ring is arranged to apply a combination of absorption and phase shift to said zero order X-ray radiation to minimize radiation dosage to which said object is exposed to produce an image.

* * * * *